US012416467B2

(12) United States Patent
Trendall

(10) Patent No.: US 12,416,467 B2
(45) Date of Patent: Sep. 16, 2025

(54) PROJECTILE CARRIER FOR A VALVELESS GAS GUN

(71) Applicant: James Edmiston, London (GB)

(72) Inventor: Simon Trendall, Crowthorne (GB)

(73) Assignee: James Edmiston, London (GB)

( * ) Notice: Subject to any disclaimer, the term of this patent is extended or adjusted under 35 U.S.C. 154(b) by 0 days.

(21) Appl. No.: 18/567,720

(22) PCT Filed: Jun. 24, 2022

(86) PCT No.: PCT/EP2022/067316
§ 371 (c)(1),
(2) Date: Dec. 6, 2023

(87) PCT Pub. No.: WO2023/280590
PCT Pub. Date: Jan. 12, 2023

(65) Prior Publication Data

US 2024/0271904 A1 Aug. 15, 2024

(30) Foreign Application Priority Data

Jul. 6, 2021 (EP) ..... 21183889

(51) Int. Cl.
*F41B 11/682* (2013.01)
*F41B 11/73* (2013.01)

(52) U.S. Cl.
CPC ..... *F41B 11/682* (2013.01); *F41B 11/73* (2013.01)

(58) Field of Classification Search
CPC ..... F41B 11/62; F41B 11/682; F41B 11/73
See application file for complete search history.

(56) References Cited

U.S. PATENT DOCUMENTS 5,762,057 A 6/1998 Laabs et al.
2007/0186761 A1* 8/2007 Perry ..... F41B 11/73 89/7

(Continued)

FOREIGN PATENT DOCUMENTS

DE 102009039549 A1 3/2011
EP 2623918 B1 8/2016

OTHER PUBLICATIONS

International Search Report for PCT/EP2022/067316 dated Sep. 2, 2022, 3 pages.

(Continued)

*Primary Examiner* — Bret Hayes
(74) *Attorney, Agent, or Firm* — NIXON & VANDERHYE

(57) ABSTRACT

Projectile carrier for a gas gun with a barrel defining a barrel bore arranged to guide a projectile, the projectile carrier including a projectile carrier bore for holding a projectile aligned with a barrel bore of the gas gun and to be sealingly in communication with a pressure chamber when the projectile carrier is in a service position, the projectile carrier being adapted to receive a projectile when in a loading position. The projectile carrier is distinct from the barrel and includes at least one projectile retaining element held in place by at least one locking element arranged to move on the projectile carrier between a locking position, in which the at least one projectile retaining element is engaged with a retention surface included by the projectile, and an unlocked position, in which the projectile is free to move under the effect of pressure in the pressure chamber.

13 Claims, 6 Drawing Sheets

(56) References Cited

U.S. PATENT DOCUMENTS

| | | | | |
|---|---|---|---|---|
| 2010/0006080 | A1* | 1/2010 | Chen | F41B 11/73 124/73 |
| 2010/0229844 | A1* | 9/2010 | Gore | F41B 11/73 124/80 |
| 2012/0325192 | A1* | 12/2012 | Pham | F41B 11/72 124/83 |
| 2018/0216910 | A1* | 8/2018 | Malarkey | F41B 11/60 |
| 2021/0108879 | A1* | 4/2021 | Clemons | F41B 11/643 |
| 2022/0099404 | A1* | 3/2022 | Sullivan | F41B 11/721 |

OTHER PUBLICATIONS

Written Opinion of the ISA for PCT/EP2022/067316 dated Sep. 2, 2022, 9 pages.

* cited by examiner

PROJECTILE CARRIER FOR A VALVELESS GAS GUN

CROSS-REFERENCE TO RELATED APPLICATIONS

This application is the U.S. national phase of International Application No. PCT/EP2022/067316 filed Jun. 24, 2022 which designated the U.S. and claims priority to EP 21183889.1 filed Jul. 6, 2021, the entire contents of each of which are hereby incorporated by reference.

TECHNICAL FIELD

The present invention relates to the field of gas actuated guns, that is to say guns in which a projectile is launched by means of a compressed gas such as air. Such gas guns have applications as alternatives to firearms or conventional artillery in which the propulsive force is provided by a chemical propellant such as gunpowder or nitro powder, or for other applications such as generation of shocks for initiation of explosives or for seismic-type measurements, for driving bolts, nails or similar into materials such as concrete, wood, stone, metal or similar, and so on.

STATE OF THE ART

Typically, gas guns comprise a pressure chamber connected to a barrel by means of a valve. When a projectile is positioned in the barrel and the pressure chamber is filled with a gas such as air, nitrogen or similar, opening the valve allows the gas to exert a propulsive effect on the projectile, accelerating it down the barrel. This valve may either be part of the gun, or contained within a so-called gas cartridge, which is a removable element comprising the pressure chamber, valve and means to hold the projectile, hence serving also as a projectile carrier.

In such conventional valved arrangements, the maximum velocity of the projectile attainable as it leaves the barrel is typically limited by the rapidity with which the valve can be opened. Simply increasing the pressure in the pressure chamber often has no substantial effect on the velocity above a certain point, since the projectile has left the barrel before this extra pressure can be brought to bear, due to the choking effect of the valve as it opens and the fact that the projectile has typically left the barrel before the valve has fully opened.

U.S. Pat. No. 5,762,057 describes a gas gun which does not suffer from this velocity limitation. Rather than having a valve, the projectile is situated in the barrel proximate to the pressure chamber such that it seals the barrel by means of an appropriate seal such as a polymer O-ring. The projectile is held in its initial position by a restraining pin which passes through an oblique bore and engages with a circumferential groove in the projectile and is held in position by disengaging means such as a piston. By actuating the piston to retract the restraining pin from the circumferential groove, the projectile is free to accelerate down the barrel under the effect of the pressure of the gas in the pressure chamber acting on its base. As a result, the system does not have a valve, and the choking effect caused by the valve opening is not present. As a result, far greater velocities are attainable than with a conventional valve, all else being equal.

However, this arrangement presents significant disadvantages in that the projectile must be loaded from the muzzle end of the barrel and engaged by the restraining pin, which is extremely slow and severely limits the rate at which projectiles can be launched. Furthermore, since an opening must be provided for the passage of the restraining pin, there is a risk of damaging the projectile's seal during loading due to the edges of the opening catching on the elastic material of the seal.

EP 2 623 918 discloses a pneumatic launcher system which comprises an air reservoir with an opening of substantially the same diameter as a launching tube which can be positioned in fluid communication therewith. This launching tube holds a projectile which is retained therein by a plurality of ball bearings maintained in engagement with a groove in the projectile by means of a sliding locking collar. To launch the projectile, the locking collar is moved axially, permitting the ball bearings to leave the groove and the pressure in the air reservoir to propel the projectile along the launching tube, which also acts as a barrel. Multiple launching tubes can be affixed to each other to allow a rapid reload, or multiple separate tubes can be provided.

The primary disadvantage of this arrangement is that the launching tube not only carries the projectile, but also serves as a barrel. This means that for a single launching tube, the entire tube must be dismounted for a new projectile to be inserted. As a result, in practice, the tube has to be relatively lightweight in order to be manipulated by the user, limiting the working pressure. The use of ball bearings to retain the projectile also implies relatively low working pressure, since they offer limited contact areas with the projectile and hence tend to bite into the material thereof and deform it. On the topic of the use of ball bearings, their size and shape limit the wall thickness of the tube and their protrusion therefrom, again limiting the maximum working pressures, and they are easily susceptible to jamming by debris.

In the case of the system being used as a rifle or artillery, since the entire tube has to be removed, the accuracy potential of the system is very limited, since it is difficult or impossible to obtain the exact same alignment between the frame containing the air reservoir and the tube when this is removed and replaced. Also, fast reloading, multiple tubes are required, whether joined together or separate, which is extremely bulky.

An aim of the present invention is hence to at least partly overcome the above-mentioned disadvantages of the prior art.

DISCLOSURE OF THE INVENTION

More precisely, the invention relates to a projectile carrier for a gas gun as defined in claim 1. This gas gun may for instance be an air rifle, air pistol, pneumatic artillery piece, nail/bolt gun, and comprises a barrel defining a smooth-bore or rifled barrel bore arranged to guide a projectile, as is generally known.

The projectile carrier according to the invention is movable or removable from such a gun, and comprises a projectile carrier bore arranged to hold a projectile aligned with the barrel bore and to be sealingly in communication with a pressure chamber when the projectile carrier is in a service position (i.e. in position and with the bore of the projectile carrier aligned with the bore of the barrel), and to be able to receive a projectile when the projectile carrier is in a loading position (i.e. not in the service position and with access to the bore of the projectile carrier, for instance with the projectile carrier dismounted or moved so as to provide this access). This applies whether the pressure chamber is part of the projectile carrier (i.e. this latter is an air cartridge system) or is part of the gun (i.e. the projectile carrier is simply a caddy-type system).

the projectile carrier, which is distinct from the barrel and hence the projectile carrier bore is distinct from the barrel bore, comprises at least one projectile retaining element held in place by at least one locking element arranged to move on the projectile carrier between a locking position and an unlocked position, and which acts on the at least one projectile retaining element directly or indirectly, in the latter case e.g. via a lever or a locking arm. In the locking position, the at least one projectile retaining element is engaged with a retention surface comprised by the projectile (such as a circumferential groove, one or more notches or similar provided therein, or the front portion of the projectile, whether it be a sloped surface commonly referred to as an "ogive" or a flat front surface, depending on the shape of the projectile), whereas in the unlocked position the projectile is free to move under the effect of the pressure in the pressure chamber. The locking element is typically furthermore adapted such that its displacement from its locked position to its unlocked position can be controlled by an actuator comprised by the gas gun.

As a result, loading of a valveless gas gun is significantly faster than with the muzzle-loaded arrangement of the prior art since it is faster to load the projectile carrier, and in the case of multiple projectile carriers being present, they can be pre-loaded with projectiles and inserted sequentially into the gun. In respect of the tube launcher of the prior art, the fact that the projectile carrier is not integrated with the barrel and is separate therefrom means that the barrel can be rigidly attached to the frame, increasing the accuracy potential of the gas gun. Furthermore, since the barrel is not integrated with the projectile carrier, this latter can be significantly more compact, easier to handle, and permits thicker sidewalls and hence has the potential to work at higher operating pressures, giving greater possible projectile energy.

Advantageously, the at least one projectile retaining element is a lever, a pin or a ball bearing, the number thereof being chosen in accordance with need. In the case of multiple levers, these can be either pivotably mounted on the projectile carrier or arranged as a collet. Both levers and pins can be arranged to have significantly greater contact surfaces with the projectile than ball bearings, and are less sensitive to debris that may cause jamming.

In one variant, the locking element is a plunger which cooperates hydraulically with the at least one projectile retaining element.

Advantageously, the locking element is a sliding sleeve, which may be biased in its locking position by means of an elastic element, and which interacts directly or indirectly with the at least one projectile retaining element. In the case of indirect cooperation, this can for instance be by means of at least one lever or locking arm.

This sleeve advantageously comprises a tubular extension arranged to maintain the at least one projectile retaining element in engagement with the projectile. In particular, this tubular extension may comprise a cylindrical inner surface arranged to block the at least one projectile retaining element in engagement with the projectile, and an interior beveled surface situated towards the open end of the tubular extension. This interior beveled surface automatically returns the projectile retaining element or elements into their engaged position once the projectile has departed and the actuator no longer maintains the locking element in its unlocked position.

In one variant, the pressure chamber is integrated with the projectile carrier so as to form an air cartridge. In such a case, the pressure chamber may be integrally formed therewith or may be a separate element attached thereto e.g. by threads, a locking collar, a bayonet mount or similar. In such a case, a protective shroud can advantageously be provided so as to limit access to the locking element, and thereby prevent accidental discharge when the projectile carrier is not in its service position.

This variant can be utilized with an air cartridge type gas gun comprising:

- a frame;
- a barrel directly or indirectly to said frame and defining a barrel bore arranged to guide a projectile;
- a housing provided directly or indirectly in the frame adapted to receive a projectile carrier according to the previous paragraph such that the projectile carrier bore is aligned with the barrel bore;
- an actuator (e.g. a trigger mechanism) directly or indirectly to said frame adapted to move the locking element from its locked position to its unlocked position.

In an alternative variant, the pressure chamber is integrated into the gas gun, and hence the projectile carrier does not contain it. In such a situation, the projectile carrier is a caddy-type system. In such a case, the corresponding gas gun comprises:

- a frame;
- a barrel attached directly or indirectly to said frame and defining a barrel bore arranged to guide a projectile;
- a pressure chamber attached directly or indirectly to said frame and adapted to contain a pressurised gas;
- a housing provided directly or indirectly in the frame adapted to receive a projectile carrier of a type defined above which does not itself contain the pressure chamber, such that the projectile carrier bore is aligned with the barrel bore and sealingly in communication with the pressure chamber provided in the gas gun itself;
- an actuator attached directly or indirectly to the frame and adapted to move the locking element from its locked position to its unlocked position.

BRIEF DESCRIPTION OF THE DRAWINGS

Further details of the invention will become apparent upon reading the detailed description below, in reference to the annexed figures in which.

EMBODIMENTS OF THE INVENTION

Figure 1:
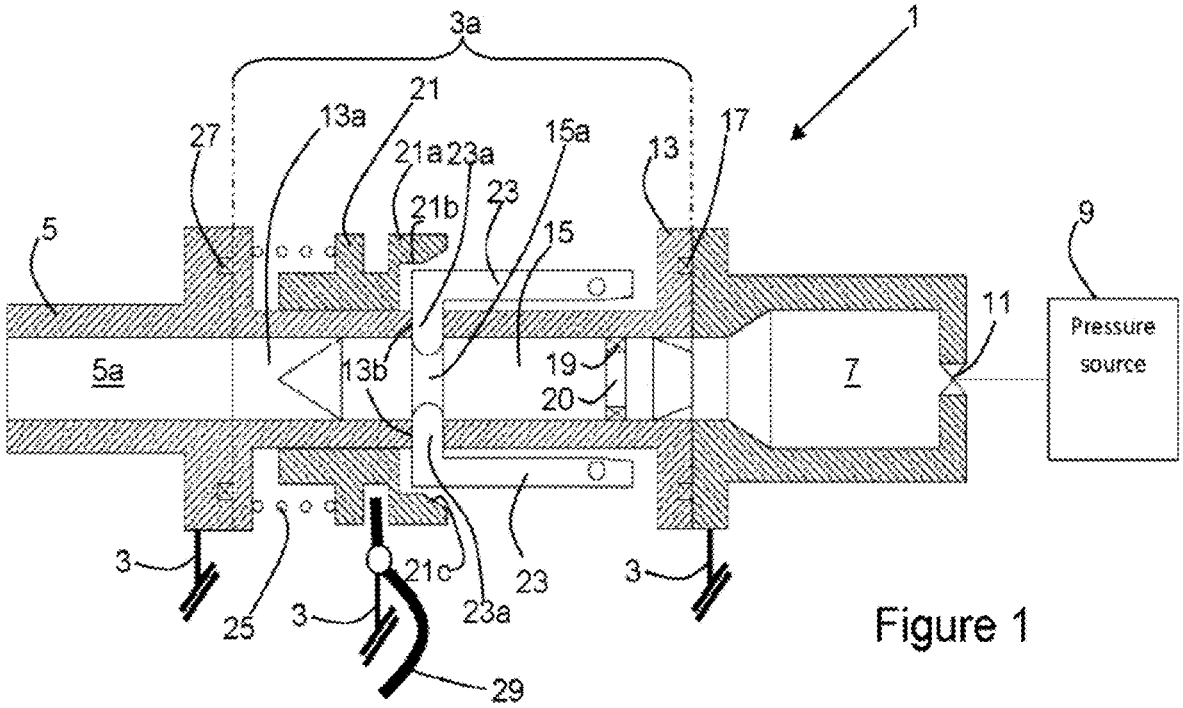
FIG. 1 schematically represents a gas gun provided with a non-limiting embodiment of a projectile carrier according to the invention in cross section, in a position ready to launch a projectile.
Figure 2:
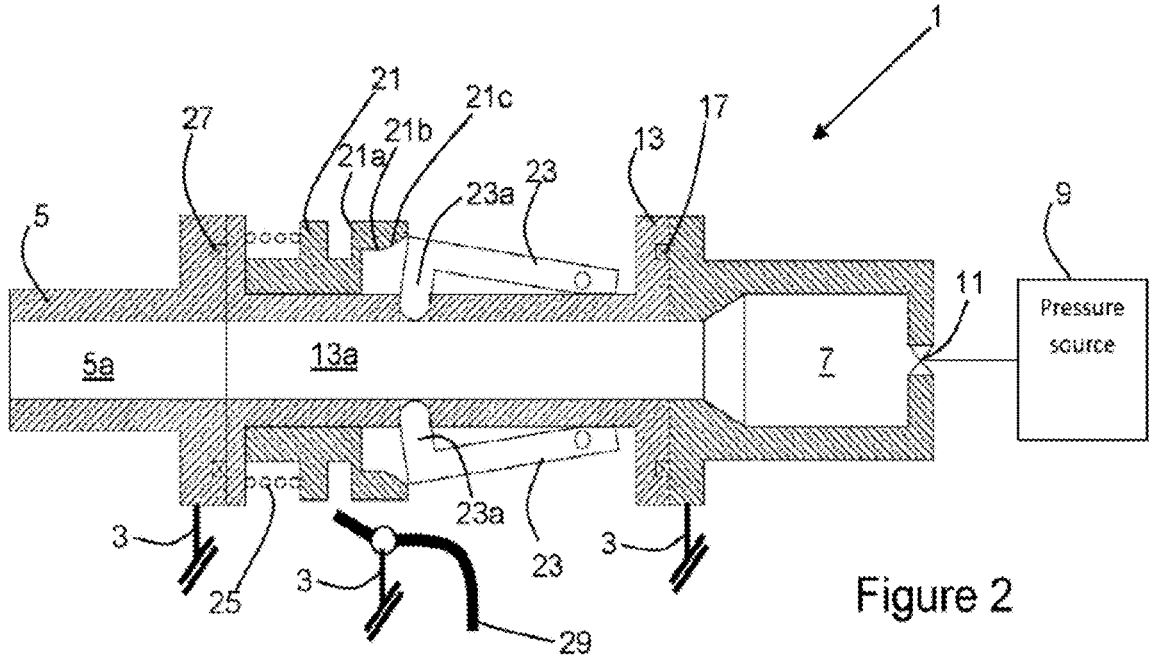
FIG. 2 schematically represents the gas gun of FIG. 1 in cross section, immediately after launching a projectile.

FIGS. 1 and 2 illustrate schematically a gas gun 1 provided with a projectile carrier 13 according to a first non-limiting embodiment of the invention.

Gas gun 1 comprises a frame 3 (represented schematically by appropriate symbols) to which a barrel 5 and a pressure chamber 7 are attached. Depending on the nature of the gas gun 1, the frame may comprise e.g. a chassis to which is attached a stock, pistol grip, a mount, or any other suitable known elements, depending on whether it is a rifle, pistol, artillery piece or other.

Barrel 5 is a tube with a cylindrical barrel bore 5*a*, which may be smooth bored or provided with rifling in order to impart a spin to a projectile about its major axis, as is generally known and hence need not be explained at length. The barrel 5 may be rigidly fixed to the frame 3 such that it can only be exchanged with a tool by technician, or so that it can be easily exchanged by the user.

Pressure chamber 7 is defined by a cavity which can be filled with gas such as air, nitrogen or similar from a pressure source 9 (such as a gas bottle, compressor or similar) via a valve 11. Pressure source 9 may be integrated with the gun (e.g. fixed to the frame permanently or removably), or may be a separate element attached via a hose.

In the illustrated embodiment, the pressure chamber 7 is coaxial with the barrel 5, however this does not have to be the case. It is, however, advantageous for it to be so, since this minimises resistance to the gas flow upon projectile release.

The pressure chamber 7 is brought into fluid communication with the barrel 5 by means of a projectile carrier 13, comprising a projectile carrier bore 13*a* arranged to receive and to support a projectile 15 aligned with the bore 5*a* of the barrel 5 when the projectile carrier 13 is in its service position as indicated in the figures. Projectile carrier 13 may have a circular, square or polygonal cross-section, considered perpendicular to the axis of the projectile carrier bore 13*a*. As is clear from the figures, the barrel 5 and the carrier 13 are distinct parts not integrated with each other, and hence barrel bore 5*a* and carrier bore 13*a* are likewise distinct features, since they are provided on the aforementioned two distinct, separate parts, which can be brought together so as to align the two bores 5*a*, 13*a* with each other.

Furthermore, in this service position, the projectile carrier 13 is held in a housing 3*a* (illustrated schematically) secured to or integral with the frame 3, with its rear face of (i.e. its face facing the pressure chamber) sealed to the front face of pressure chamber 7 (i.e. the face of the pressure chamber facing the barrel 5) by means of a pressure chamber seal 17, which may be an O-ring seal of any convenient polymer or elastomer material suitable to withstand the pressure in the pressure chamber 7, which is typically up to 300 bar gauge. Such materials (such as nylon, PTFE, rubber and similar) are well known in the art and need not be described at length.

Projectile 15 is provided with at least one projectile seal 19 arranged in a corresponding circumferential groove 20 of appropriate size, in order to seal the projectile to the projectile carrier bore 13*a* and prevent gas escape. Since the projectile seal 19 is subject to significant frictional forces during the launch of the projectile 15, the choice of material is limited to those capable of withstanding the friction and heat generated, for instance nylon, PTFE, or even soft metals such as lead arranged so as to provide an interference fit with the projectile carrier bore 13*a*. Since the base of the projectile 15 is exposed to the full pressure in the pressure chamber 7 while waiting to be launched due to there being no valve between the two, the projectile seal is hermetic.

The shape of the projectile 15 is generally cylindrical, cylindroconical, ogival or similar, and many examples of projectile shapes are well known in the art, and indeed the projectile may be inert or have an explosive load. Typically the cross-section of the projectile 15 is circular, but polygonal Whitworth-type and oval Lancaster-type shapes are also possible. Projectile 15 may also be provided with a sabot, and may even be a bolt, nail or similar intended to be driven by the gas gun 1 into a material for building purposes.

In order to retain the projectile 15 in the projectile carrier 13, at least one projectile retaining element 23 is provided, mounted to the projectile carrier (and hence not directly to the frame 3). In the illustrated embodiment, a pair of projectile retaining elements 23 are visible, but the number may vary, and experiments have shown that six is a particularly advantageous number. In this instance, each projectile retaining element 23 is an L-shaped lever mounted pivotally on the projectile carrier 13 and provided with an extremity 23*a* extending through a respective lateral opening 13*b* formed in the sidewall of the projectile carrier 13. The tip of each extremity 23*a* is curved or bevelled, and is adapted to engage with a retention surface 15*a* comprised by the projectile 15. In the illustrated embodiment, this retention surface is formed as a recess 15*a* of complementary form to the tips of the extremity 23*a*, which is provided in the outer wall of the projectile 15. As illustrated, the tips are rounded, and the recess 15*a* is formed as a circumferential groove with a similar profile to the tips. Alternatively, the tips may be bevelled into a symmetrical or asymmetrical "V" shape, the recess or recesses 15*a* having a complementary form. Furthermore, the extremities 23*a* may be curved so as to follow the circumference of the recess 15*a*. As a further alternative, the extremities 23*a* may engage with front portion of the projectile, whether this be the inclined surface of a so-called ogival form, or a flat front face if such is present.

Other forms of projectile retaining elements 23 are also possible, such as ball bearings, pins or similar.

In order to maintain the projectile retaining elements 23 in engagement with the projectile 15, at least one locking element 21 is provided.

In the illustrated embodiment, locking element 21 is a sleeve slidingly mounted on the outer wall of the projectile carrier 13 and provided with a cylindrical extension 21*a* shaped so as to block the retaining elements 23 in engagement with the projectile 15 when the sleeve is in its locking position as illustrated in FIG. 1, and thereby prevent the retaining elements 23 from disengaging from the projectile 15. The sleeve is maintained in this locking position by means of an elastic element 25, e.g. a coil spring, arranged so as to bias the locking element 21 towards the projectile retaining elements 23, i.e. in the direction of the pressure chamber 7, so as to retain it in the locking position.

As can be seen from FIG. 1, the projectile seal 19 is situated closer to the pressure chamber 7 than the recess 15*a* (or other retention surface as applicable), in order to prevent gas leaks through the openings 13*b* and obviate the need for good sealing at these points.

The projectile carrier 13 is sealed to the rear face of the barrel 5 by means of a barrel seal 27 similar to pressure chamber seal 17, although this feature can be omitted at the cost of slight loss of pressure between the projectile carrier 13 and the barrel 5 during discharge.

In order to launch the projectile 15, the projectile carrier 13 is placed in its service position as illustrated in FIG. 1, the pressure chamber 7 is then pressurised from the pressure source 9, and the locking element 21 is moved from its locking position into an unlocked position by means of an actuator 29 mounted to the frame 3. This actuator 29 has been illustrated as a simple trigger lever pivoted on the frame, but other arrangements are also possible, which may be purely mechanical, magnetic, electromechanical, pneumatic, hydraulic, or any combination thereof.

As the locking element 13 is moved to the point at which the projectile retaining elements 23 are no longer blocked in position, the cooperation between the shape of the recess 15*a* (or other retaining surface) and the projectile retaining elements 23 causes these latter to cam out of their position as the pressure force on the base of the projectile 15 forces it towards the barrel 5. Once the projectile is disengaged from the projectile retaining elements, it is free to accelerate along the barrel 5 under the effect of the gas pressure in the pressure chamber 7.

In the illustrated embodiment, the tubular extension 21*a* comprises an interior cylindrical surface 21*b* arranged to block the projectile retaining elements 23 in their engaged position, and an interior bevelled surface 21*c* situated towards the open end of the tubular extension 21*a*. This bevelled surface 21*c* is arranged such that, once the projectile 15 has departed, the elastic element 25 returns the locking element 21 to its original position by camming the projectile retaining elements 23 into their locking positions as illustrated in FIG. 1.

This particular arrangement, although advantageous, is not limiting, and many other possible arrangements of locking elements 21 are possible. In the case in which the extremities of the projectile retaining elements 23 are perpendicular to the bore axis, the locking element or elements 21 need to actively cam them out of engagement with the recess or recesses 21 by means of levers, linkages, cams, cam tracks or similar, by rotating, sliding, pivoting or otherwise displacing the locking element or elements 21.

In order to load the projectile carrier 13, it is arranged to be movable or removable. For instance, it may be hinged or slidingly mounted on the frame 3 so as to be able to be moved from its service position (as illustrated) into a loading position distinct from the service position. In this loading position, a projectile can be inserted into the projectile carrier bore 13*a* manually or via an autoloader mechanism, from either end thereof, an insertion following the direction of projectile traffic being preferred (but not obligatory) since it avoids all risk of damaging the seal 19 since it does not have to be pushed past the openings 13*b*. Alternatively, the projectile carrier may be completely removable. An appropriate positioning means such as a catch, locking system or similar may be provided to maintain the projectile carrier 13 securely in its service position.

Furthermore, multiple projectile carriers 13 may be attached together, e.g. by being linked together in a belt or chain, arranged in a revolver cylinder type manner, or attached side by side in a harmonica-type arrangement, the arrangement of projectile retaining elements 23 and locking elements 21 being adapted in consequence. Another possibility is storing multiple removable projectile carriers 13 in a magazine or hopper, with a suitable feeding mechanism to bring them sequentially into their service position.

As can be seen from the foregoing, the gas gun 1 of the invention is valveless (as in that it has no valve between the pressure chamber 7 and the projectile), so can generate high projectile 15 velocities, yet can nevertheless be loaded relatively rapidly by means of one or more projectile carriers 13.

Furthermore, since the pressure chamber 7 is fixed to the frame 3 of the gas gun 1 and is not formed integrally with the projectile carrier 13 in the manner of an air cartridge, there is no risk of a projectile being launched outside of the gas gun 1 in the case in which the locking element 21 is accidentally actuated.

Figure 3:
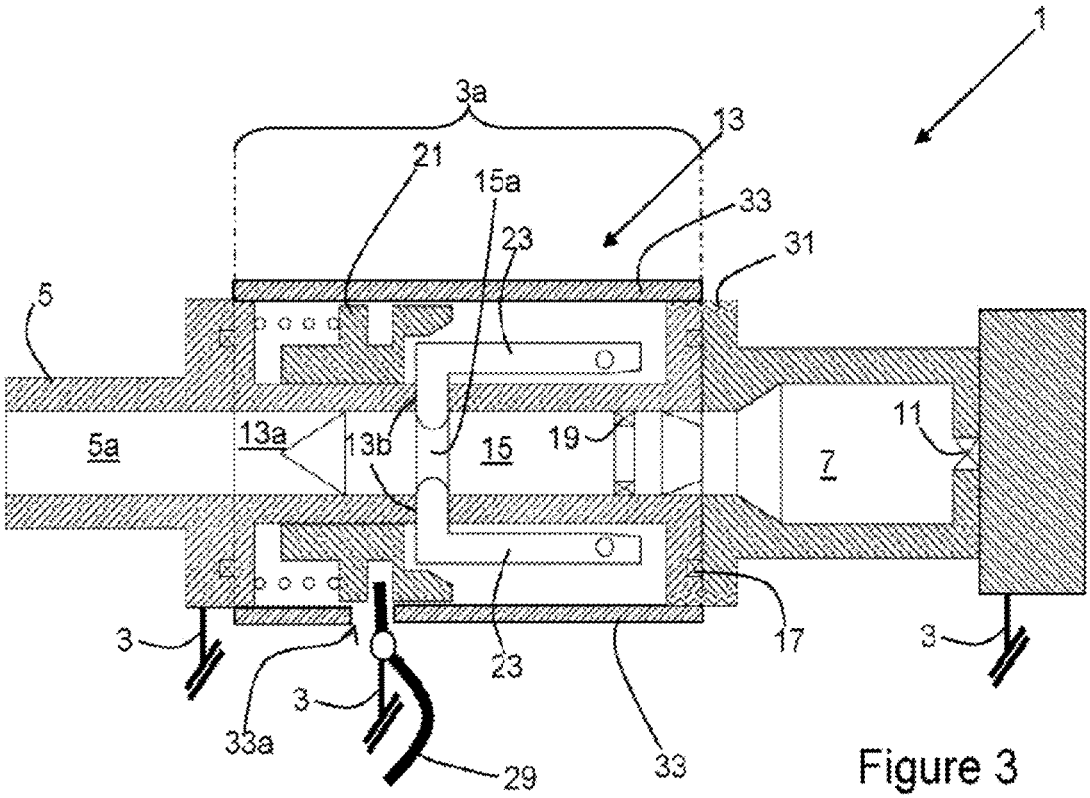
FIG. 3 schematically represents a further nonlimiting embodiment of a gas gun provided with a projectile carrier according to a second non-limiting embodiment of the invention in a view similar to that of FIG. 1.

FIG. 3 illustrates a further non-limiting embodiment of a gas gun 1 incorporating a projectile carrier 13 according to the invention, in which this latter takes the form of an air cartridge. In the interests of brevity, this construction will be described in terms of how it differs from that of FIGS. 1 and 2, and only those reference signs used below in the text are reproduced on FIG. 3, the other features remaining unchanged.

The fundamental difference between the embodiment of FIG. 3 and that of FIGS. 1 and 2 is that the pressure chamber 7 is integrated into the projectile carrier 13 such that this latter constitutes an air cartridge, the pressure chamber 7 being pressurised after insertion of the projectile 15, when the projectile carrier 13 is not in its service position.

In the illustrated embodiment, the pressure chamber 7 is formed in a separate element which is then attached to the portion of the projectile carrier 13 incorporating the projectile carrier bore 13*a*, e.g. by screw threads, a threaded locking collar 31 (as illustrated), a bayonet mount or any other convenient means. In order to load a projectile 15, the pressure chamber 7 can be unscrewed from the remainder of the projectile carrier 13 and the projectile 15 can be inserted in its direction of travel upon launch (i.e. from right to left in the orientation of the figures), or alternatively the pressure chamber 7 can remain attached and the projectile 15 loaded in the other direction with the increased risk of damage to the seal 19 that this entails, as noted above in the context of FIG. 1. In an alternate construction, part of the projectile carrier bore 13*a* may be provided in the element containing the pressure chamber 7, and a mechanical abutment (such as a shoulder) arranged as a projectile stop can be provided therein. In such a case, the projectile can be placed base first against this mechanical abutment, and the remainder of the projectile carrier 13 attached thereto, the dimensions being chosen such that the projectile retaining elements 23 engage directly with the groove 15*a*.

Alternatively, the pressure chamber 7 may be formed integrally (i.e. as a single piece) with the portion of the projectile carrier 13 incorporating the projectile carrier bore 13, which permits elimination of the pressure chamber seal 17 and the means to attach the pressure chamber 7 to the portion of the projectile carrier 13 containing the projectile carrier bore 13*a*. This arrangement comes with the proviso that the projectile seal 19 passes the lateral openings 13*b* upon loading from the front (i.e. in the direction opposite to projectile travel upon launch), with the attendant risk of damage to the seal 19, although this can be mitigated by careful manufacture.

Since an accidental actuation of the locking element 21 when the pressure chamber 7 is pressurised and the cartridge carrier 13 is not in the gun 1 in its service position presents a danger of accidental discharge, a protective shroud 13 can be fixed thereto and arranged such that the actuator 29 can access the locking element 21 via an access port 33*a* provided in the shroud 33, but it is difficult or impossible for this latter to be accidentally actuated otherwise.

In FIGS. 4-11, only reference signs of note and/or indicating features referred to herebelow are included, in order not to overload the figures.

Figure 4:
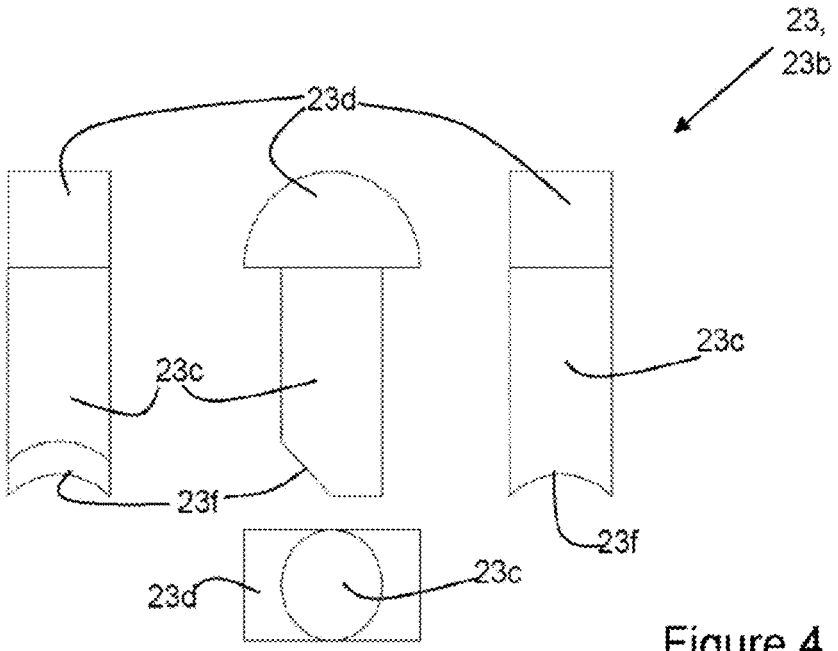
FIG. 4 schematically represents, in three side views and one bottom view, a particular variant of a pin which can serve as projectile retaining element.
Figure 5:
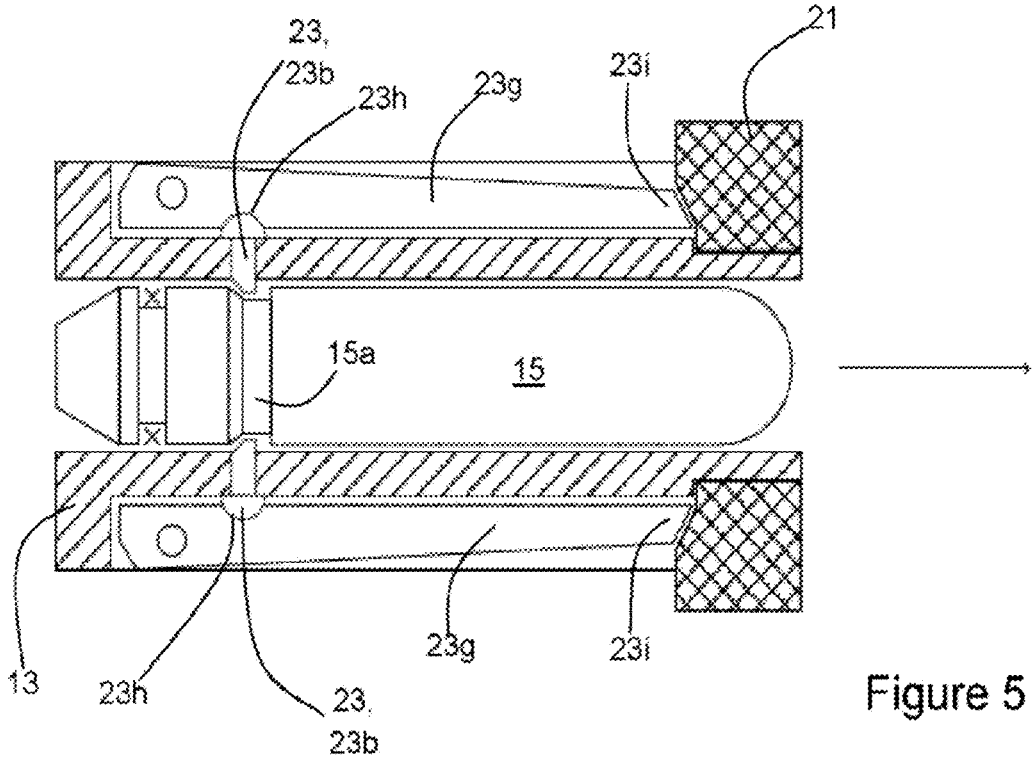
FIG. 5 illustrates schematically in cross-section a particular arrangement of projectile carrier in which the pins of FIG. 4 are maintained in position by levers which are themselves retained and released by the locking element.
Figure 7:
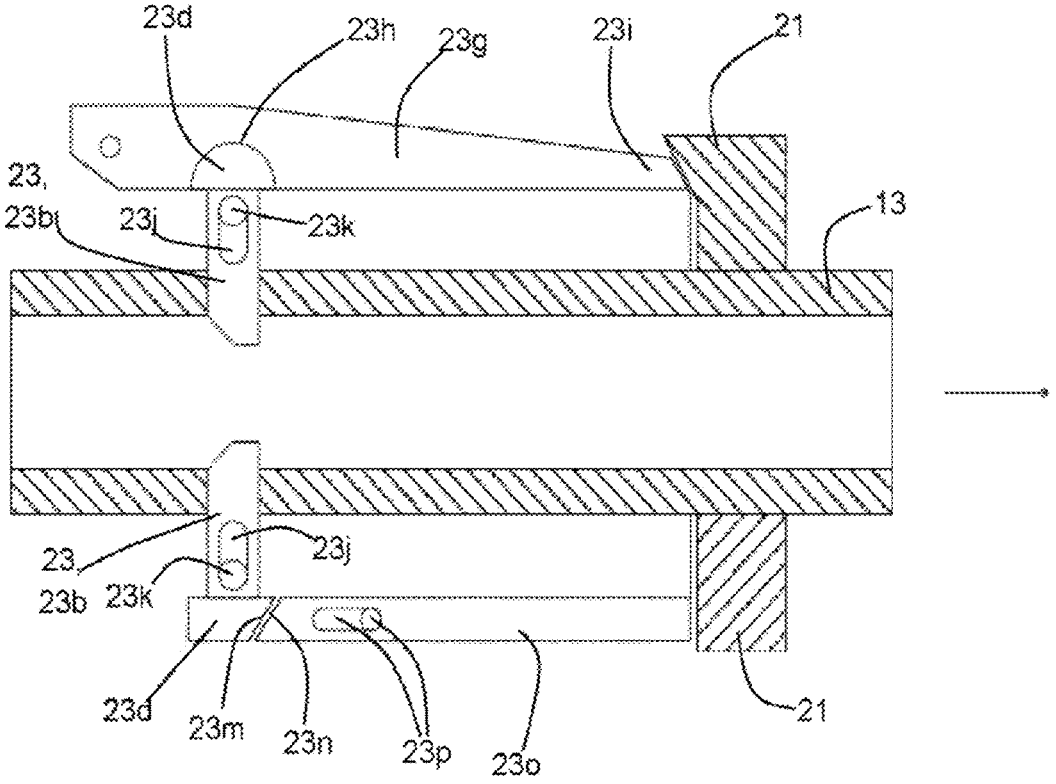
FIG. 7 illustrates two variations of arrangements for blocking the pin 23*b* in its engaged position.
Figure 11:
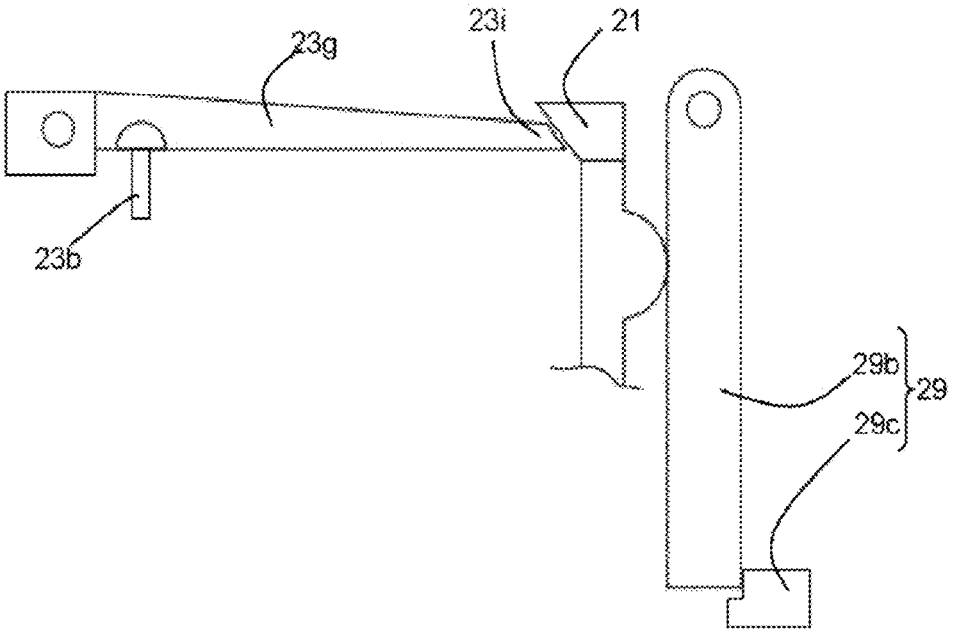
FIG. 11 illustrates in partial cross-sectional view a particular arrangement for retaining and releasing the pins in an arrangement derived from that of FIG. 5.

FIG. 4 illustrates a variant of a pin 23*b* serving as projectile retaining element 23, primarily adapted to functionally replace the extremity 23*a* of the lever 23 of FIGS. 1-3, and its application in this role is illustrated in FIGS. 5, 7 and 11. This pin 23*b* comprises a cylindrical body 23*c* (though polygonal cross sections are also possible) and a radiused head 23*d* of rectangular profile adapted to cooperate with a corresponding radiused recess 23*h* provided in a lever 23*g* pivotably mounted on the body of the projectile carrier 13. The head 23*d* extends beyond the cylindrical body to limit the travel of the pin in the direction of the bore axis. The opposite end 23*f* of the pin 23*b* is cut conically to engage with a conical retaining surface of the groove 15*a* on the projectile 15.

This arrangement provides a good contact surface between the pin 23*b* and the retaining surface in the groove 15*a* on the projectile 15, enabling relatively high pressures to be withstood without damaging the material of the projectile 15, as is the case with ball bearings.

To retain the pins 23*b*, each lever comprises a distal extremity 23*i* which cooperates with a tubular locking element which can be as in FIGS. 1-3, or may, as illustrated in FIG. 5, simply comprise an angled surface cooperating with a corresponding angled surface at each distal extremity 23*i*.

Figure 6:
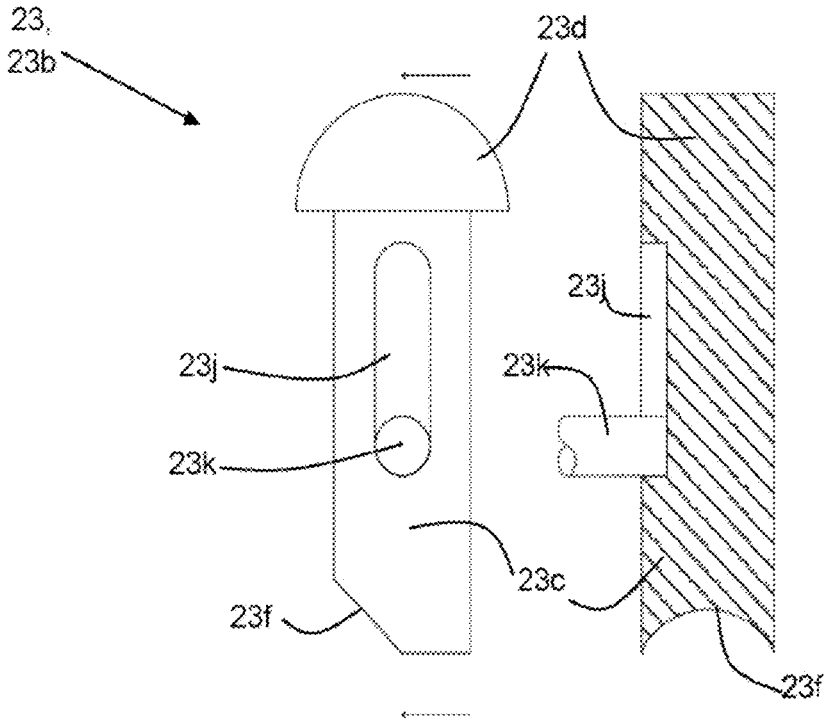
FIG. 6 schematically represents a particular manner of guiding the pins of FIG. 4.

FIG. 6 shows a nonlimiting manner in which the pin 23*b* can be prevented from rotating about its axis. As illustrated, the pin 23*b* comprises a longitudinal groove 23*j* in its body 23*c*, in which a guide pin 23*k* carried by the projectile carrier 13 runs so as to prevent the rotation of the pin 23*b* and to delimit its extreme positions parallel to its own axis. Alternatively, the pin 23*b* can carry the guide pin 23*k*, and the groove can be provided in the projectile carrier 13.

FIG. 7 illustrates two variations of arrangements for blocking the pin 23*b* in its engaged position. In the upper half of the figure, the arrangement is as in FIG. 5 and hence need not be described further.

In the lower half of the figure, the head 23*d* of the pin 23*b* comprises a camming face 23*m* which cooperates with a further camming face 23*n* formed at a first extremity of a locking arm 230 arranged to move linearly in translation, guided by a pin and slot arrangement 23*p*, and held in place by the sliding sleeve locking element 21. Movement of the sliding sleeve in the direction of projectile travel (indicated with the arrow) allows the force exerted by the projectile 15 (not illustrated on this figure) on the pin 23*b* to cam the locking arm 230 in the same direction, allowing the pin 23*b* to move out of engagement with the projectile 15.

Figure 8:
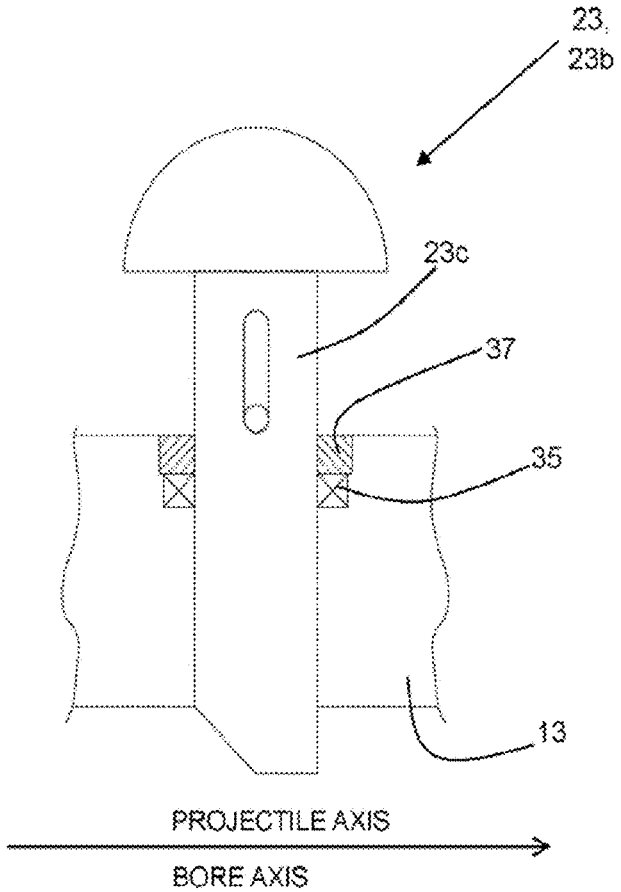
FIG. 8 illustrates in schematic cross-section a manner in which the pins of FIG. 4 can be sealed to the projectile carrier.

FIG. 8 illustrates a manner of sealing the body 23*c* of the pin 23*b* to the side wall of the projectile carrier 13. An O-ring seal 35 is provided in such a manner as to seal the body 23*c* to the projectile carrier 13, retained in place by a retaining element 37. As illustrated, the O-ring seal 35 is provided in a recess in the projectile carrier 13, but it could also be provided in a groove in the pin body 23*c*. This arrangement minimises gas leakage upon projectile launch.

Figure 9:
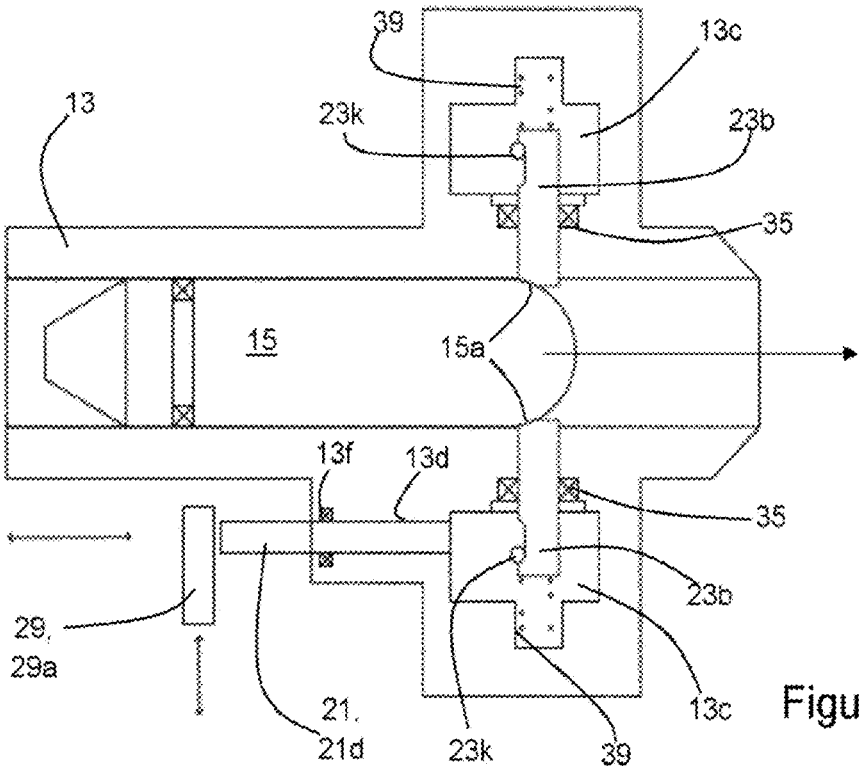
FIG. 9 illustrates in schematic cross-section a particular variant in which the pins are retained and released hydraulically.

FIG. 9 illustrates a further variant in which the pins 23*b* act on the curved surface of the nose of the projectile 15 which hence acts as retention surface 15*a*, and are retained hydraulically.

The pins 23*b* are guided by a slot and guide pin arrangement similar to that used with an AR-15 rifle ejector and which hence need not be described in detail. The ends of the pins 23*b* are situated in an annular plenum chamber 13*c* provided in the projectile carrier 13 and filled with hydraulic fluid. Pin return springs 39 of any convenient type (e.g. coil springs) bias the pins 23*b* towards their engaged positions, and seals 35 are provided as in FIG. 8.

In this configuration, the locking element 21 is a plunger 21*d* which is situated in a plunger bore 13*d* which is in fluidic communication with the plenum chamber 13*c*. The plunger 21*d* is sealed to the plunger bore 13*d* by means of a plunger seal 13*f*. As a result, the plunger 21*d* and hydraulic fluid in the plenum chamber 13*c* can displace each other as is generally known in the field of hydraulics.

In the situation illustrated in FIG. 9, the force that the projectile 15 exerts on the pins 23*b* tends to cause them to retract, and thereby move into the plenum chamber. This is resisted by the hydraulic fluid and the plunger 21*d*, which is held in position by a sear abutment 29*a* serving as actuator 29. Movement of the sear abutment 29*a* away from the projectile bore allows the plunger 21*d* to move away from the plenum chamber 13*c*, allowing the pins 23*b* to retract and free the projectile 15.

Figure 10:
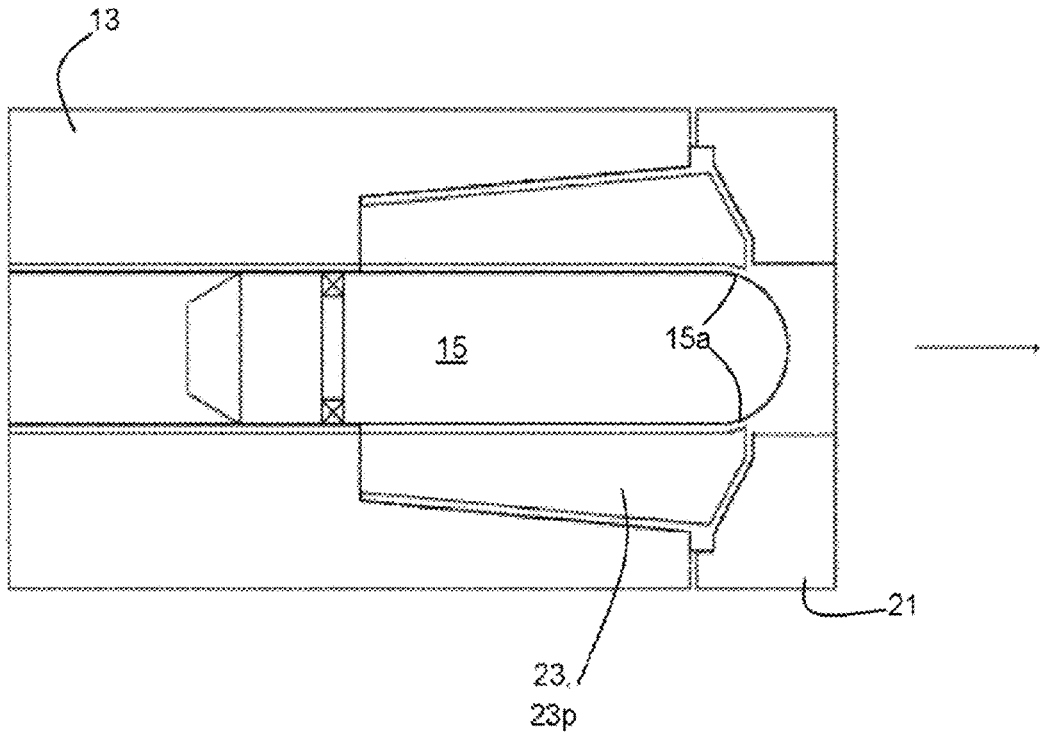
FIG. 10 illustrates in partial schematic cross-section a yet further variant of a projectile carrier in which the projectile retaining elements are a plurality of levers arranged as a collet.

FIG. 10 illustrates yet another arrangement, in which the retaining element 23 comprises a plurality of levers formed as a collet 23*p*, cooperating with the projectile 15 as in FIG. 9. Alternatively, the ends of the levers forming the collet 23*p* can cooperate with the projectile 15 as in FIGS. 1-3. The open end of the collet 23*p* cooperates with the sliding sleeve locking element 21 as in FIG. 5.

Finally, FIG. 11 partially illustrates a variant of FIG. 5 in which the lever 23*g* is maintained in position by a sliding sleeve locking element 21 as before, this latter being retained by a pivoting lever 29*b* itself being held by a sear 29*c*, these latter two elements constituting the actuator 29.

Although the invention has been described in terms of specific embodiments, variations thereto are possible without departing from the scope of the invention as defined in the appended claims.

The invention claimed is:

1. A projectile carrier for a gas gun provided with a single barrel defining a barrel bore configured to guide a projectile, said projectile carrier comprising:

a projectile carrier bore configured to hold a projectile aligned with said barrel bore of said gas gun and to be sealingly in communication with a pressure chamber when the projectile carrier is in a service position, the projectile carrier being configured to receive a projectile when in a loading position; and at least one projectile retaining element held in place by at least one locking element configured to move on the projectile carrier between a locking position, in which the at least one projectile retaining element is engaged with a retention surface comprised by the projectile, and an unlocked position, in which the projectile is free to move under the effect of pressure in the pressure chamber, wherein the projectile carrier is a separate part from the single barrel.

2. The projectile carrier according to claim 1, wherein the at least one projectile retaining element is at least one lever, pin or ball bearing.

3. The projectile carrier according to claim 1, wherein said locking element is a plunger configured to cooperate with said at least one projectile retaining element hydraulically.

4. The projectile carrier according to claim 1, wherein the at least one locking element is a sliding sleeve configured to slide on the projectile carrier, and which is configured to act directly or indirectly on said at least one projectile retaining element.

5. The projectile carrier according to claim 4, further comprising an elastic element configured to bias the sleeve in the locking position.

6. The projectile carrier according to claim 5, wherein the sleeve comprises a tubular extension configured to maintain the at least one projectile retaining element in engagement with the projectile.

7. The projectile carrier according to claim 6, wherein the tubular extension comprises a cylindrical inner surface configured to block the at least one projectile retaining element in engagement with the projectile, and an interior bevelled surface situated towards the open end of the tubular extension.

8. The projectile carrier according to claim 4, wherein said sliding sleeve is configured to act indirectly on said at least one projectile retaining element via at least one lever or locking arm.

9. The projectile carrier according to claim 1, wherein the pressure chamber is integrated therewith.

10. The projectile carrier according to claim 9, further comprising a protective shroud configured to limit access to the locking element.

11. The projectile carrier according to claim 1, wherein the projectile carrier bore is configured to be brought into communication with the pressure chamber when the projectile carrier is in said service position, the pressure chamber being integrated with said gas gun.

12. A gas gun comprising:

a frame;

a barrel attached to the frame and defining a barrel bore configured to guide a projectile;

a housing provided in the frame configured to receive the projectile carrier according to claim 9 such that the projectile carrier bore is aligned with the barrel bore; and an actuator attached to the frame and configured to move the locking element from the locked position to the unlocked position.

13. A gas gun comprising:

a frame;

a barrel attached to the frame and defining a barrel bore configured to guide a projectile;

a pressure chamber attached to the frame and configured to contain a pressurized gas;

a housing provided in the frame configured to receive the projectile carrier according to claim 11 such that the projectile carrier bore is aligned with the barrel bore and sealingly in communication with the pressure chamber; and an actuator attached to the frame and configured to move the locking element from the locked position to the unlocked position.

* * * * *